US009187873B2

(12) United States Patent
Nelson

(10) Patent No.: US 9,187,873 B2
(45) Date of Patent: Nov. 17, 2015

(54) SCREEN-HANDLING SYSTEM AND METHOD OF INSTALLING SCREENING ON A ROCK FACE

(71) Applicant: Yves Nelson, Ontario (CA)

(72) Inventor: Yves Nelson, Ontario (CA)

(73) Assignee: 1311854 Ontario Limited, Ontario (CA)

( * ) Notice: Subject to any disclaimer, the term of this patent is extended or adjusted under 35 U.S.C. 154(b) by 10 days.

(21) Appl. No.: 13/855,212

(22) Filed: Apr. 2, 2013

(65) Prior Publication Data

US 2014/0294514 A1 Oct. 2, 2014

(51) Int. Cl.

| | |
|---|---|
| ***E02D 3/00*** | (2006.01) |
| ***E01F 7/04*** | (2006.01) |
| ***E21D 11/15*** | (2006.01) |
| ***E21D 20/00*** | (2006.01) |
| ***E21D 21/00*** | (2006.01) |

(52) U.S. Cl.

CPC . *E02D 3/00* (2013.01); *E01F 7/045* (2013.01); *E21D 11/152* (2013.01); *E21D 20/003* (2013.01); *E21D 21/00* (2013.01)

(58) Field of Classification Search

CPC ..... E21D 11/152; E21D 11/40; E21D 20/003
USPC ..... 405/258.1, 259.1, 272, 278, 302.3
See application file for complete search history.

(56) References Cited

U.S. PATENT DOCUMENTS

| | | | | |
|---|---|---|---|---|
| 3,399,927 | A * | 9/1968 | Groetschel | 299/11 |
| 6,981,559 | B2 * | 1/2006 | Rubie et al. | 173/184 |
| 8,137,033 | B1 * | 3/2012 | Hinshaw et al. | 405/302.3 |
| 8,662,796 | B2 * | 3/2014 | Brown | 405/302.3 |
| 2011/0166824 | A1 * | 7/2011 | Haisty et al. | 702/157 |
| 2012/0213598 | A1 * | 8/2012 | Lugg et al. | 405/290 |

* cited by examiner

*Primary Examiner* — Tara M. Pinnock
(74) *Attorney, Agent, or Firm* — Allen J. Moss; Squire Patton Boggs (US) LLP

(57) ABSTRACT

A screen-handling stinger extends and retracts hydraulically from within a bore of a hydraulic stinger of a rock bolter. The screen-handling stinger has a finger that engages a screen. The screen-handling stinger retracts the screen until it snugly abuts the front face of a pad of the stinger. The screen can then be rotated by the rotation motor of the stinger.

19 Claims, 6 Drawing Sheets

SCREEN-HANDLING SYSTEM AND METHOD OF INSTALLING SCREENING ON A ROCK FACE

CROSS-REFERENCE TO RELATED APPLICATIONS

This application claims the benefit of priority from Canadian Patent Application Serial No. 2,811,722, filed in the name of Yves Nelson on Apr. 2, 2013, and entitled "Screen-Handling System and Method of Installing Screening on a Rock Face," the contents of which are incorporated by reference.

TECHNICAL FIELD

The present invention relates generally to mining equipment and, in particular, to rock bolting and screening.

BACKGROUND

In a mine, ground support, e.g. rock bolts and screening, is used to prevent rock falls. Several different types of rock bolts may be used but all require that holes be drilled in the rock first. This is done with equipment known as rock bolters. These are mobile units with a bolting head attached. To drill a hole in the rock to install ground support, the bolting head is placed against the rock face (which is called "stinging the face") and then a hole is drilled into the rock. The unit is then indexed to install the ground support such as screening. As is known in the mining industry, wire mesh screening is installed in mines to prevent loose rocks from falling.

Using conventional technologies, the installation of screening has been found to be problematic. Known equipment is generally complex, expensive and prone to breakdown. A need therefore exists for an improved technology for installing screening on a rock face in a mine.

SUMMARY

In general, the present invention provides a novel screen handling system (also referred to herein as a "screen handler") and a novel method of installing screening. The screen handler (screen-handling system) has an actuator incorporated within a stinger. The actuator causes a screen-engaging finger (or stem) to extend and retract relative to the stinger. The finger engages or hooks the screen and then the actuator retracts (pulls) the screen snugly against the outer face of a stinger pad of the stinger. The screen, clamped against the outer face of the stinger pad, can thus be manipulated (e.g. displaced or rotated). The screen is then placed against the rock face in a mine. Rock bolts may then be used to fasten the screen to the rock face.

Accordingly, one aspect of the present invention is a screen handler (or screen-handling system or screen-handling stinger) that includes a hydraulic stinger having a bore, a screen-handling actuator disposed within the bore of the hydraulic stinger for extending and retracting relative to the stinger, and a screen-engaging finger connected to a movable forward end of the actuator to engage a screen.

Another aspect of the present invention is a method of installing screening on a rock face. The method entails providing a screen-handling stinger having a screen-handling actuator disposed within a bore of the stinger, extending the screen-handling actuator relative to the stinger such that a screen-engaging finger connected to a movable forward end of the actuator hooks onto a screen, retracting the screen-handling actuator until the screen abuts a stinger pad of the hydraulic stinger, and bolting the screen to the rock face.

Yet another aspect of the present invention is a rock bolting and screen-installing system comprising a drill feed for drilling a hole in a rock face, a bolting feed for installing a rock bolt into the hole, a screen-handling stinger for stinging a rock face to stabilize the system when drilling, wherein the stinger comprises a bore and a screen-handling actuator disposed within the bore of the stinger for extending and retracting relative to the stinger.

Yet a further aspect of the present invention is a screen handler for handling a screen. The screen handler includes a screen-handling actuator mounted to a forward end of a feed rail and a screen-engaging finger connected to a forward movable end of the actuator for engaging the screen and for retracting the screen against a pad disposed at a forward end of the screen handler.

BRIEF DESCRIPTION OF THE DRAWINGS

Further features and advantages of the present invention will become apparent from the following detailed description, taken in combination with the appended drawings, in which.

It will be noted that throughout the appended drawings, like features are identified by like reference numerals. It should furthermore be noted that the drawings are not necessarily to scale.

DETAILED DESCRIPTION

By way of introduction, the present invention provides a screen handling system ("screen handler") and a method of installing screening on a rock face of a mine.

The screen handler (screen-handling system or screen-handling stinger) has a screen-handling actuator incorporated within a central bore of a hydraulic stinger of a rock bolter. The hybrid-function stinger thus has both the functions of a conventional stinger (to sting the rock face to stabilize the rock bolter for drilling and bolting) but also enables screening to be gripped and manipulated for installation on the rock face.

Figure 1:
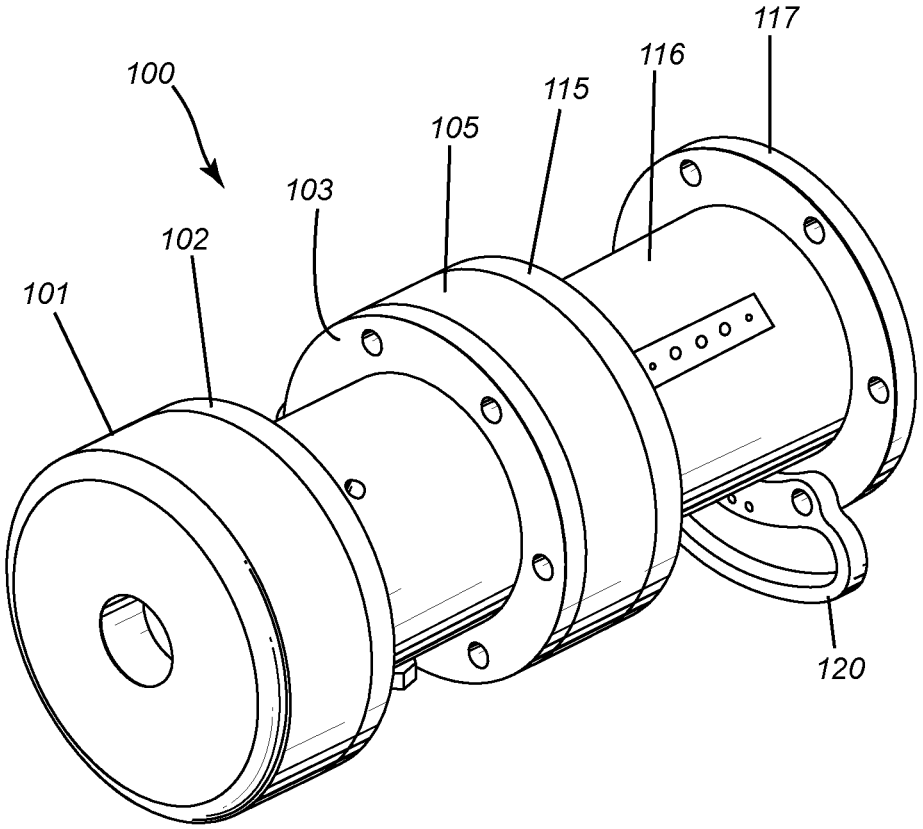
FIG. 1 is an isometric view of a screen handler in accordance with an embodiment of the present invention (shown in its retracted posture)

The screen handler (screen-handling stinger) is illustrated in FIG. 1. As shown in FIG. 1, the screen-handling stinger, which is generally designated by reference numeral 100 has two main subsystems: (i) a modified hydraulic stinger having an internal central bore and (ii) a screen-handling actuator subassembly that extends from and retracts into the central bore of the stinger. The screen-handling stinger is thus both a stinger and a screen-handling device. In other words, this invention may be understood as a stinger that includes a screen-handling mechanism. For the purposes of this specification, the term "screen handler" shall be meant to include a mechanism that includes a stinger and a screen-handling actuator. Similarly, the term "screen-handling stinger" shall mean a stinger that includes a screen-handling mechanism.

Figure 2:
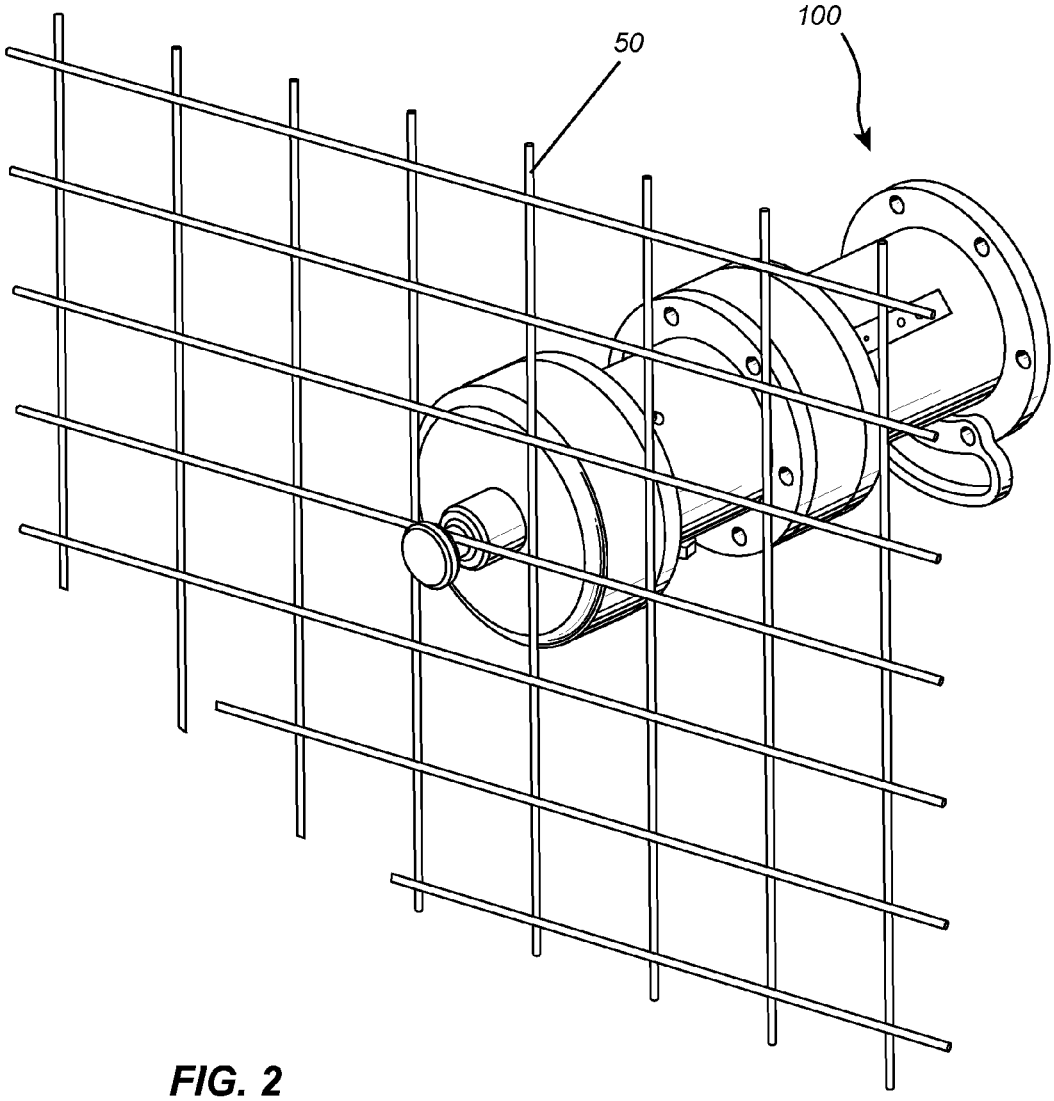
FIG. 2 is an isometric view of the screen handler holding a screen against a stinger pad.

As depicted in FIG. 1, the screen handler (or screen-handling stinger) 100 includes a stinger pad 101, a stinger pivot adapter plate 102, a stinger pivot outer housing 103, and a cylinder (actuator) retaining bracket 105 for holding a screen-handling actuator. The screen-handling stinger also includes a front rotation motor adapter plate 115, a rotation motor 116, and a rear rotation motor adapter plate 117. A hose guide 120 may also be attached. These various components will be described in greater detail below. Unlike a conventional stinger, the screen-handling stinger not only stings a rock face but also has an internal actuator that extends and retracts a screen-engaging finger to hold a screen against the stinger pad as depicted in FIG. 2. This enables the screen to be manipulated by the rock bolter to place the screen in a desired location on a rock face. The rock bolter then installs one or more rock bolts to secure the screen to the rock face.

As depicted by way of example in FIG. 2, the actuator causes a screen-engaging finger (or stem) to extend and retract relative to the stinger. The finger engages or hooks the screen 50 and then the actuator retracts (pulls) the screen snugly against the outer face of a stinger pad of the stinger. The screen, clamped against the outer face of the stinger pad, can thus be manipulated (e.g. displaced or rotated). The screen is then placed against the rock face in a mine. Rock bolts may then be used to fasten the screen to the rock face.

Screen Handler (Screen-Handling Stinger)

Figure 3:
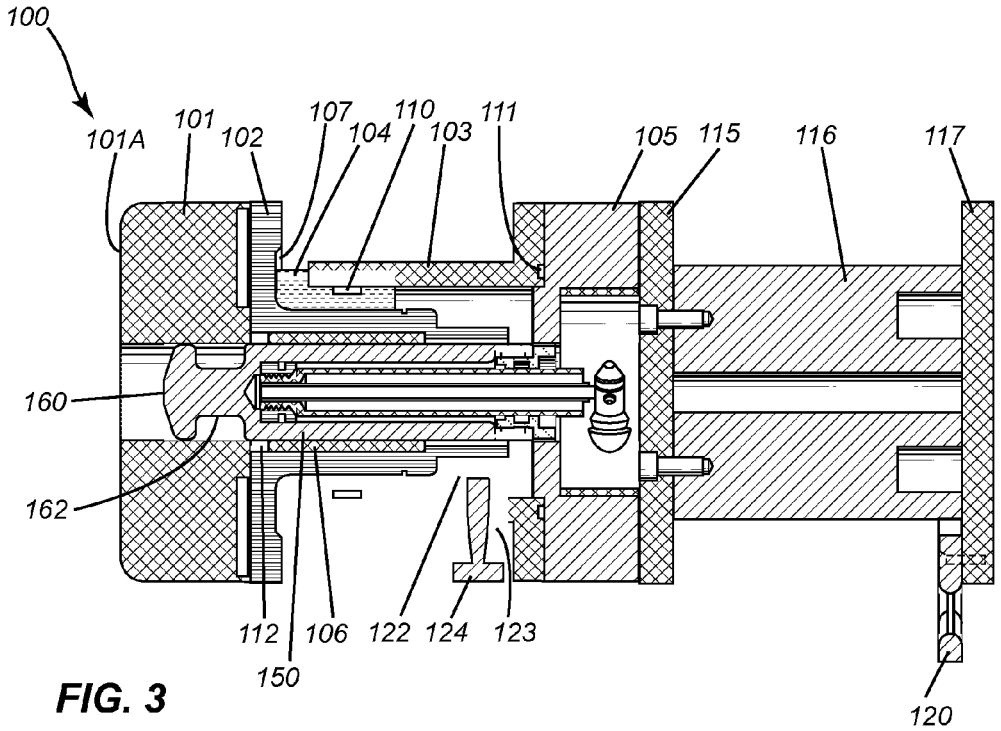
FIG. 3 is a cross-sectional view of the screen handler of FIG. 1.
Figure 4:
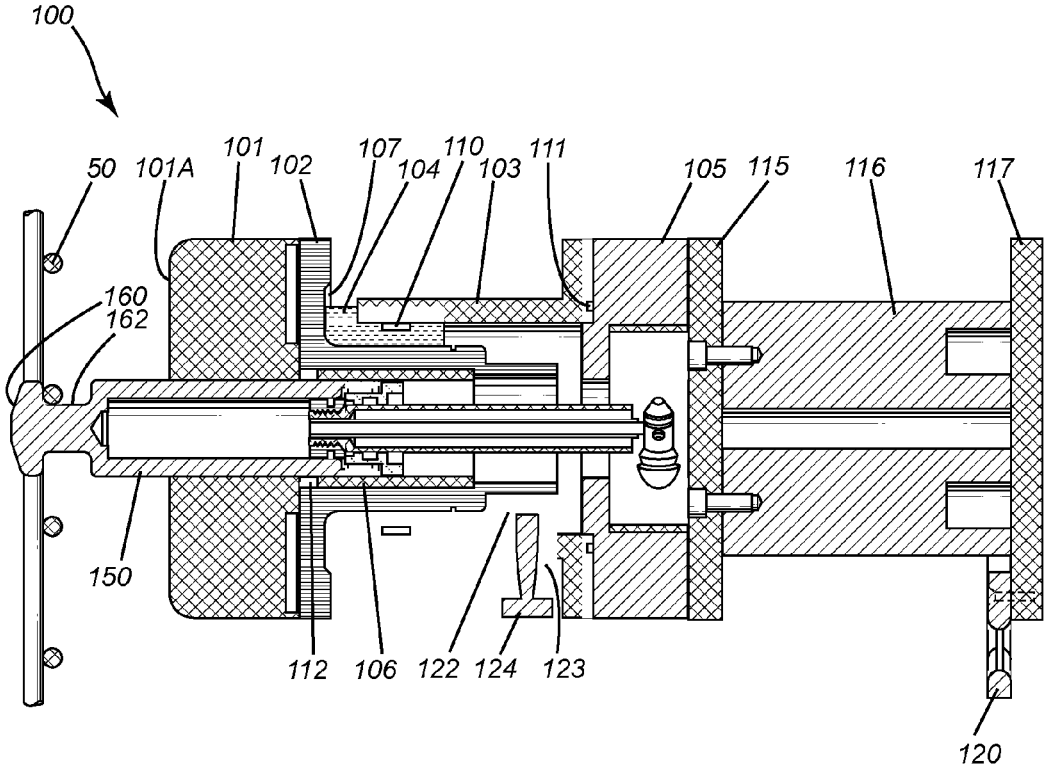
FIG. 4 is a cross-sectional view of the screen handler in an extended posture.
Figure 5:
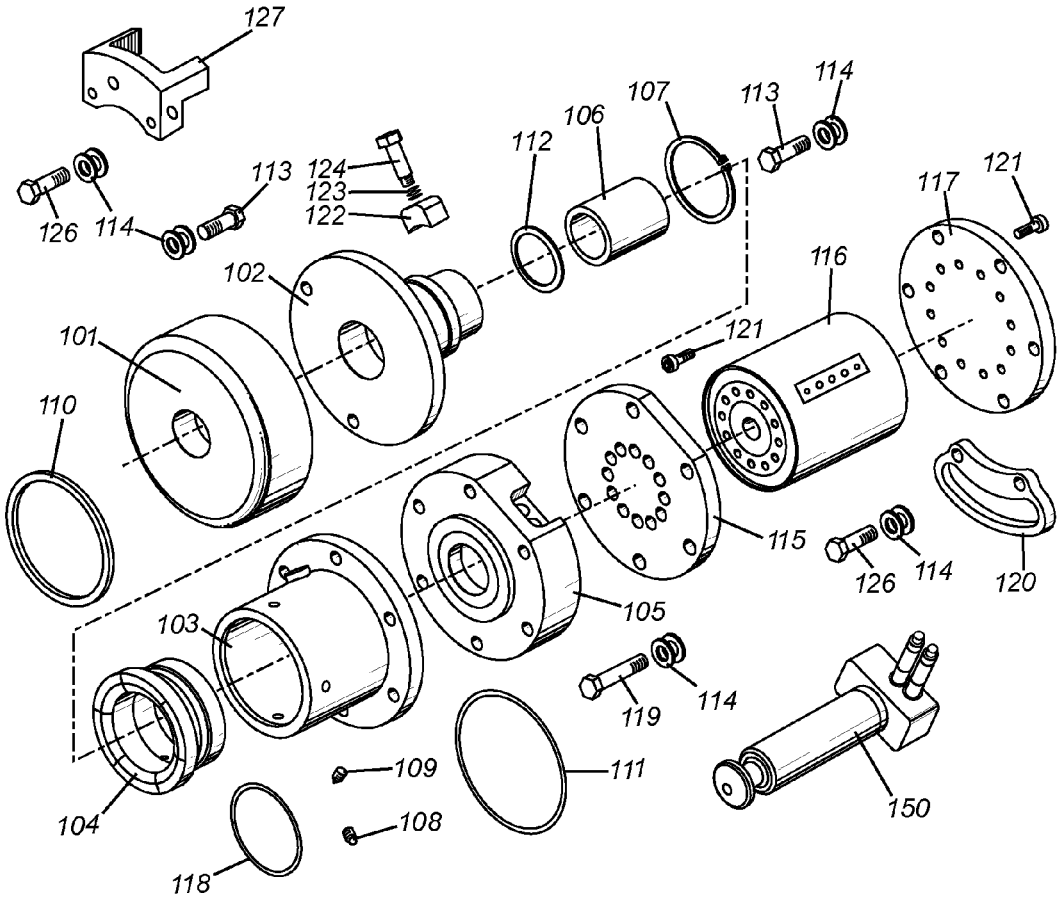
FIG. 5 is an exploded assembly view of the screen handler.

The screen-handling stinger (or "screen handler" or "screen-handling system") 100 will now be further described in greater detail with reference to FIGS. 3-5. FIG. 3 is a cross-sectional view of the screen-handling stinger of FIG. 1 (shown in the fully retracted posture). FIG. 4 is a cross-sectional view of the screen-handling stinger in a fully extended posture. As such, it is apparent from FIG. 3 and FIG. 4 that the finger moves between a first (retracted) position and a second (extended) position. FIG. 5 is an exploded assembly view of the screen-handling stinger.

As depicted in FIGS. 3-5, the screen-handling stinger 100 includes a stinger pad 101 mounted to a stinger pivot adaptor plate 102 which is rotationally mounted in the stinger pivot outer housing 103 via a stinger rotation thrust bushing 104. The bushing 104 may be retained by a retaining ring (snap ring) 107. A seal 110 may be disposed between housing 103 and bushing 104. The outer housing 103 is mounted to a cylinder retaining bracket 105. An O-ring 111 is seated in a groove in the rear face of outer housing 103 to provide a seal between housing 103 and bracket 105. The pad 101 and the adapter plate 102 each have a central bore through which the screen handler (or more specifically a finger or stem of the screen handler) may extend to engage the screen. In other embodiments, the bore may be off-axis (not centrally disposed). The shape of the pad may be circular as shown but it may also have other shapes (e.g. U-shaped, X-shaped, cross-shaped, square, rectangular, hexagonal, octagonal, etc.)

The cylinder (actuator) retaining bracket 105 retains (or houses) the actuator subassembly 150. The actuator subassembly comprises a hydraulic actuator. The actuator includes a hydraulic cylinder and an internal hydraulically driven piston, as well as a piston rod extending forwardly and connecting to a finger (stem) that extends to engage or hook onto the screen. The actuator assembly 150 may include a cylinder fitting guard 127. The cylinder sits within a cylinder guide bushing 106. A wiper 112 may be disposed between the guide bushing 106 and the rear wall of the stinger pad. The wiper wipes dirt, dust, grime, etc. from the stem (finger) when it retracts into the central bore inside the stinger.

The finger 160 has an undercut or notch 162 (zone of reduced diameter) that engages a wire mesh segment of the screen. Any other suitable mechanism may be used to hook, grip, attach or engage the screen. The forward end of the finger may have a bull-nose shape to push past a wire-mesh segment of the screen. The forward and rearward walls of the notch may be parallel to each other and have a square profile as shown.

In operation, the actuator extends to engage the wire mesh segment of the screen by hooking the screen with the undercut 162. The actuator then partly retracts the screen until the screen abuts the front face 101*a* of the stinger pad 101. The retraction of the finger thus locks or clamps the screen against the stinger pad. Once the screen is snugly abutted against the front face 101*a* of the stinger pad 101, the screen can be handled or manipulated, e.g. translated and/or rotated. Rotation of the screen is made possible by a screen handler rotation motor 116.

The cylinder retaining bracket 105 is mounted to a front rotation motor adapter plate 115 by threaded fasteners such as screws, e.g. hex head cap screws 119 with washers 114. The screen handler rotation motor 116 is mounted between the front adapter plate 115 and a rear rotation motor adapter plate 117. The motor 116 may be fastened to the front and rear plates 115, 117 by threaded fasteners such as screws, e.g. hex head cap screws 121. A hose guide 120 may be mounted to the rear plate 117 for guiding hydraulic hoses to the actuator. The hose guide 120 may be mounted to the rear plate 117 by threaded fasteners such as screws, e.g. hex head cap screws 126 and washers 114.

The actuator assembly 150 may include an adjustment mechanism. The adjustment mechanism may include a friction adjuster bolt 124 that threads into a screw thread insert (e.g. a locking Heli-Coil® insert) 123 and connects to a friction brake bushing 122. By tightening the adjuster bolt, the brake bushing 122 moves radially inwardly to increase the frictional force exerted on the rotatable forward portion of the screen-handling stinger. By loosening the adjuster bolt, the brake bushing moves radially outwardly to reduce the frictional force exerted on the rotatable forward portion of the screen-handling stinger. The rotatable forward portion of the stinger includes the pad 101, adapter plate 102, and actuator 150. The adjuster bolt may have a knob for manual adjustment or any head for adjustment using a wrench or screwdriver or other tool. The adjustment mechanism enables adjustment of the frictional coupling between the rotatable forward portion of the screen-handling stinger and the rear portion of the stinger (including housing 103). In other words, the adjustment mechanism adjusts the frictional force that frictionally couples the rotatable forward portion of the screen-handling stinger (specifically the adapter plate 102) to the rear portion (specifically outer housing 103 and indirectly the retaining bracket 105 and front plate 115 which are rotationally driven by the motor 116). In other words, the frictional coupling between components 102 and 103 is adjustable. This adjustment exerts rotational resistance on the rotation of the stinger so that it is selectively rotatable. For example, the adjustment may be set so that the forward portion of the stinger (including the actuator) rotates under a certain torque but not under other torque. For example, it may be desirable to set the adjustment mechanism to enable the forward portion of the stinger to rotate independently relative to the rear portion when indexing but to rotate the whole stinger (front and rear portions coupled together) when picking up and manipulating a screen.

Method of Installing a Screen

The screen-handling stinger (or screen-handling system or screen handler) that is disclosed herein also enables a novel method of installing screening on a rock face in a mine.

This novel method entails providing a screen-handling stinger having a screen-handling actuator disposed within a central bore of the stinger, extending the screen-handling actuator relative to the stinger such that a screen-engaging finger connected to a movable forward end of the actuator hooks onto a screen, retracting the screen-handling actuator until the screen abuts a stinger pad of the hydraulic stinger, and bolting the screen to the rock face.

In one embodiment, the method further involves rotating the screen. Rotating may be accomplished using a motor. The motor, in one embodiment, is affixed to a motor adapter plate to which an actuator retaining bracket is mounted. The actuator retaining bracket retains the screen-handling actuator in this embodiment.

In one embodiment, the method further involves wiping the actuator using a wiper. In one specific embodiment, this wiper may be disposed between a stinger pad and a guide bushing. The guide bushing may be disposed within a pivot adapter plate (i.e. within a bore or inner diameter). The adapter plate may be mounted to the stinger pad in this specific embodiment.

In one embodiment, the method further involves adjusting a frictional coupling between the adapter plate 102 and the outer housing 103. This may be accomplished using an adjustment mechanism. This adjustment mechanism may have a friction adjuster bolt that threads into a screw thread insert and connects to a friction brake bushing.

Rock Bolting and Screen Installing System

Figure 6:
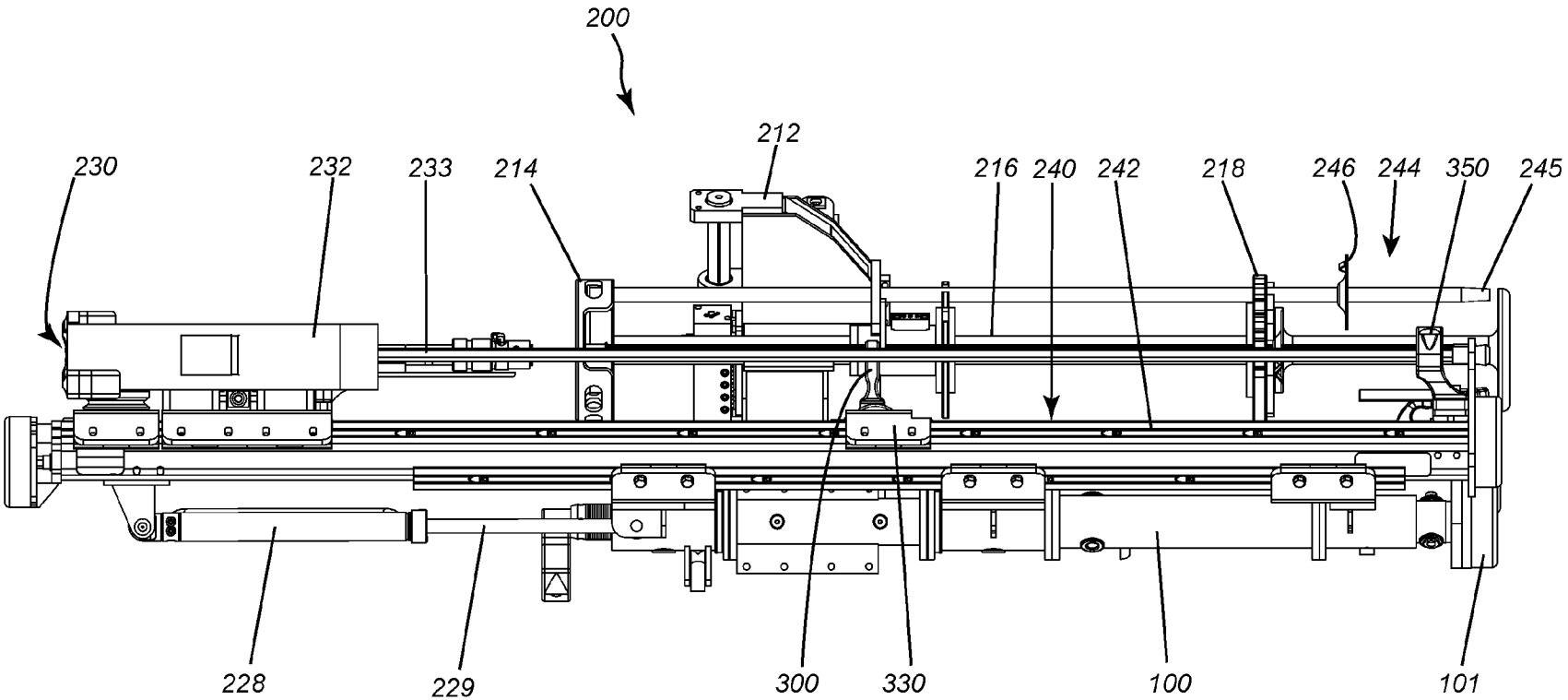
FIG. 6 is a side view of a rock bolter that includes the screen handler.

FIG. 6 is a side view of a rock bolting and screen installing system (also referred to herein as a "rock bolter"). This improved rock bolter, unlike conventional rock bolters, includes a screen handler in the form of a modified hydraulic stinger (i.e. a screen-handling stinger) having a central bore in which is disposed a screen-handling actuator.

In general, a rock bolter is designed to drill a hole and then to install a rock bolt into the hole. For the purposes of the present specification, the term "rock bolt" is meant to encompass rebar, split sets, expandable bolts, anchors or any other bolt-like elements designed to be installed in a hole in a rock face to provide ground support.

With reference to FIGS. 1-4, the rock bolter (or rock bolting system), which is generally designated by reference numeral 10, has a hydraulic stinger 20, a drill feed 30 and a bolting feed 40. Each is hydraulically actuated using a hydraulic actuator (hydraulic cylinder, piston and rod). In one specific embodiment, each of the stinger, drill feed and bolting feed may be independently movable. In operation, the rock bolter is brought close to a rock face. A rock face means either the roof or the walls of a mine. Once the rock bolter is properly positioned relative to the rock face, the rock bolter extends the stinger to sting the rock face. Stinging the rock face means engaging or contacting the rock face. Stinging is done to stabilize the rock bolter. Therefore, stinging requires that the stinger press against the rock face with sufficient force to stabilize the rock bolter. With the stinger engaged against the rock face, the rock bolter then extends the drill feed to drill a hole in the rock. Once drilling is complete, the drill is withdrawn. The finger is then extended by the screen-handling actuator from the screen-handling stinger to engage a screen. The actuator retracts to pull the screen tightly against the pad. The rock bolter then places the screen against a rock face by extending and/or rotating the stinger and affixing the screen to the rock face using one or more bolts.

As depicted in FIG. 6, the rock bolter 200 (rock bolting and screen installing system) includes the screen-handling stinger 100 and its forward bumper pad (stinger pad) 101. The rock bolter 200 includes a feed extension cylinder 228 and feed extension piston rod 229 for extending and retracting the stinger 100.

As further depicted in FIG. 6, the rock bolter 200 includes a mounting frame 212 for mounting the rock bolter to a boom, platform, or other such structure. The rock bolter 200 includes a carousel 214, a turret 216, and an indexing mechanism 218.

The drill feed 230 includes a rock drill 232 and drill steel 33 that extends to the drill bit. The drill bit is advanced by the drill feed to drill the hole in the rock face. After indexing using the indexing mechanism, the bolting feed 240 then drives a bolt 244 (having bolt tip 245) into the hole that was drilled by the drill bit of the drill feed. The bolt 244 may include a bolt plate 246. The bolt plate 246 of the rock bolt is the end plate (flange, washer or head) of the bolt that abuts the rock face when the rock bolt is inserted into the hole. The rock bolter may include a flexible traveling bolt centralizer 300 and its sliding carriage 330 that is adapted to slid on the rails 242 of the bolting feed of the rock bolter 200. The rock bolter may also include a forward stationary bolt centralizer 350 that works with the traveling centralizer to keep the bolt aligned with the hole.

This screen handler or screen-handling stinger may be an attachment that mountable to a distal and movable end of any suitable feed to enable the stinger to grip and handle screens. The stinger itself may also extend and retract relative to the rock bolter (and thus can translate or move independently of the actuator inside the stinger). With the rotational motor, the screen handler is able to both translate and rotate the screen provided the screen is snugly clamped against the stinger pad by the partly retracted finger. The bolting feed may be used to insert a bolt into the rock face to fasten the screen in place while the stinger is holding the screen against the rock face.

Feed Rail-Mounted Screen Handler

In another embodiment, the screen handler may be mounted to a conventional feed rail or to a telescopic feed rail as opposed to being mounted to, or incorporated within, a hydraulic stinger. This feed rail may be either a drill feed rail or a bolt feed rail. A rotation motor may be mounted inside the feed rail (i.e. along an axis of the feed rail) or outside of the feed rail (i.e. off-axis). For an off-axis motor, suitable gears, chain drive, belt drive or other power transmission means are provided to transmit power from the motor to rotate the screen handler.

Figure 7:
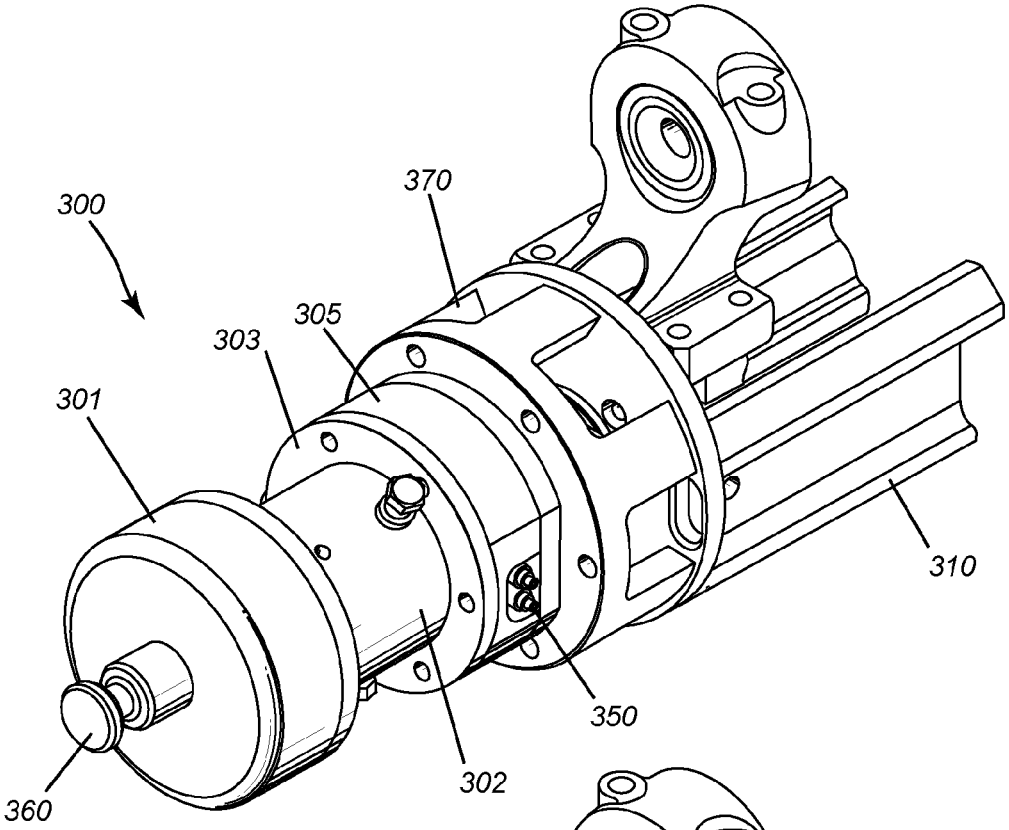
FIG. 7 is an isometric view of a screen handler (in its extended position) mounted to a drill feed in accordance with another embodiment of the present invention.
Figure 8:
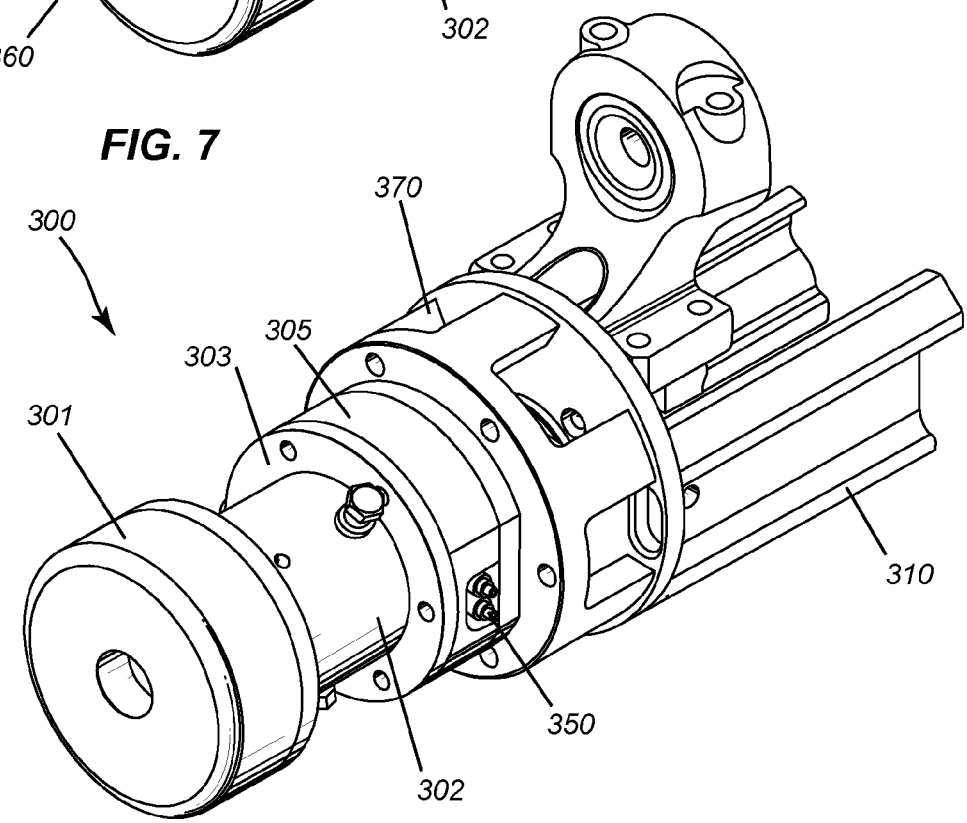
FIG. 8 is an isometric view of the screen handler of FIG. 7, shown in its retracted position.

FIG. 7 and FIG. 8 show a feed-mounted screen handler 300 in accordance with another embodiment of the present invention. The screen handler 300 is mounted to a drill feed rail 310 in the illustrated example by a suitable mounting bracket, flange or attachment 370. The screen handler may also be mounted to other types of feed rails. The screen handler has a cylindrical or circular bumper pad 301 (although the pad may have any other suitable shape). The pad is 301 is disposed at a forward end of the screen handler. An actuator 350 linearly displaces the finger 360 along an axis of displacement that is substantially parallel to and aligned with the feed rail although it may be off-axis in other embodiments. The finger 360 of the actuator 350 extends from a central bore (although the bore need not be aligned centrally as shown). The finger is adapted (shaped and sized) to engage a wire segment of the screen and to pull the screen back against the pad 301 to thereby clamp or secure the screen against the pad 301. The pad 301 is mounted to an adapter plate 302 which is mounted to an outer housing 303 and an actuator-retaining bracket 305. The bracket 305 retains the hydraulic actuator 350 that extends and retracts the finger 360.

This novel screen handler thus enables miners to install protective screening on rock faces of mines. This invention facilitates, and renders more efficient, the installation of screening in a mine.

The present invention has been described in terms of specific embodiments, examples, implementations and configurations which are intended to be exemplary or illustrative only. Other variants, modifications, refinements and applications of this innovative technology will become readily apparent to those of ordinary skill in the art who have had the benefit of reading this disclosure. Such variants, modifications, refinements and applications fall within the ambit and scope of the present invention. Accordingly, the scope of the exclusive right sought by the Applicant for the present invention is intended to be limited solely by the appended claims and their legal equivalents.

The invention claimed is:

1. A screen-handling stinger comprising:

a hydraulic stinger including a stinger pad mounted to a forward surface of the hydraulic stinger, the hydraulic stinger and stinger pad together defining a bore;

a screen-handling actuator disposed within the bore of the hydraulic stinger; and a screen-engaging finger connected to a movable forward end of the actuator to move the finger between a retracted position within the bore to an extended position extending outside of the bore beyond the stinger pad to thereby engage a screen.

2. The screen-handling stinger as claimed in claim 1 wherein the finger comprises a notch for hooking onto a wire-mesh segment of the screen.

3. The screen-handling stinger as claimed in claim 1 further comprising a motor for rotating the screen-handling stinger.

4. The screen-handling stinger as claimed in claim 1 wherein the stinger pad is mounted to a pivot adapter plate, the pivot adapter plate being mounted via a rotation thrust bushing to a pivot outer housing which is mounted to an actuator retaining bracket that retains the actuator.

5. The screen-handling stinger as claimed in claim 4 further comprising a guide bushing disposed within the pivot adapter plate.

6. The screen-handling stinger as claimed in claim 5 further comprising a wiper disposed between the guide bushing and the stinger pad, the wiper being adapted to wipe the actuator.

7. The screen-handling stinger as claimed in claim 1 further comprising an adjustment mechanism supported by an outer housing of the stinger, the adjustment mechanism comprising a friction adjuster bolt that threads into a screw thread insert that is inserted in the housing and connects to a friction brake bushing disposed between the housing an adapter plate for adjusting a frictional coupling between the adapter plate and the outer housing.

8. A method of installing a screen on a rock face, the method comprising:

providing a screen-handling stinger with a stinger pad mounted to the hydraulic stinger, the hydraulic stinger including a screen-handling actuator disposed within a bore formed by the hydraulic stinger and the stinger pad;

extending the screen-handling actuator relative to the stinger such that a screen-engaging finger connected to a movable forward end of the actuator extends outside of the bore beyond the pad to thereby hook onto the screen;

retracting the screen-handling actuator until the screen abuts the stinger pad of the hydraulic stinger; and bolting the screen to the rock face.

9. The method as claimed in claim 8 further comprising rotating the screen using a motor affixed to a motor adapter plate to which an actuator retaining bracket is mounted, the actuator retaining bracket retaining the screen-handling actuator.

10. The method as claimed in claim 8 further comprising wiping the actuator using a wiper disposed between a stinger pad and a guide bushing that is disposed within a pivot adapter plate mounted to the stinger pad.

11. The method as claimed in claim 8 further comprising adjusting a frictional coupling between an adapter plate and an outer housing using an adjustment mechanism having a friction adjuster bolt that threads into a screw thread insert and connects to a friction brake bushing.

12. A rock bolting and screen-installing system comprising:

a drill feed for drilling a hole in a rock face;

a bolting feed for installing a rock bolt into the hole;

a screen-handling stinger having a stinger pad for stinging a rock face to stabilize the system when drilling, wherein the screen-handling stinger and the pad together comprise a bore and a screen-handling actuator disposed within the bore for extending and retracting relative to the stinger.

13. The system as claimed in claim 12 further comprising a screen-engaging finger connected to a movable forward end of the actuator.

14. The system as claimed in claim 13 wherein the finger comprises a notch for hooking onto a wire-mesh segment of the screen.

15. The system as claimed in claim 12 further comprising a motor for rotating the stinger and actuator.

16. The system as claimed in claim 12 wherein the stinger pad is mounted to a pivot adapter plate, the pivot adapter plate being mounted via a rotation thrust bushing to a pivot outer housing which is mounted to an actuator retaining bracket that retains the actuator.

17. The system as claimed in claim 16 further comprising a guide bushing disposed within the pivot adapter plate for guiding the actuator through the bore.

18. The system as claimed in claim 17 further comprising a wiper disposed between the guide bushing and the stinger pad, the wiper being adapted to wipe the actuator.

19. The system as claimed in claim 12 further comprising an adjustment mechanism supported by an outer housing of the stinger, the adjustment mechanism comprising a friction adjuster bolt that threads into a screw thread insert that is inserted in the housing and connects to a friction brake bushing disposed between the housing an adapter plate for adjusting a frictional coupling between the adapter plate and the outer housing.

* * * * *